US006474420B1

(12) United States Patent
Adiga

(10) Patent No.: US 6,474,420 B1
(45) Date of Patent: Nov. 5, 2002

(54) DEVICE AND METHOD FOR CONTROLLING FIRE

(76) Inventor: Kayyani C. Adiga, 4999 Oxford Rd., Macon, GA (US) 31210

( * ) Notice: Subject to any disclaimer, the term of this patent is extended or adjusted under 35 U.S.C. 154(b) by 0 days.

(21) Appl. No.: 09/634,622

(22) Filed: Aug. 5, 2000

(51) Int. Cl.[7] ..... A62C 2/00; A62C 8/00

(52) U.S. Cl. ..... 169/47; 169/46; 169/48; 169/50

(58) Field of Search ..... 169/43, 46, 47, 169/48, 49, 50, 54, 70; 252/2, 601

(56) References Cited

U.S. PATENT DOCUMENTS

| | | | | |
|---|---|---|---|---|
| 4,361,190 A | * | 11/1982 | Szego | 169/48 |
| 4,602,611 A | * | 7/1986 | Hankey et al. | 169/50 X |
| 5,158,144 A | | 10/1992 | Shaw et al. | |
| 5,738,175 A | | 4/1998 | Alhamad | |
| 6,048,805 A | * | 4/2000 | Gottfried | 169/48 X |
| 6,062,316 A | * | 5/2000 | Alhamad | 169/48 X |

OTHER PUBLICATIONS

K.C. Adiga, D.E. Ramaker, P.A. Tatem, and F.W. Williams, Numerical Predictions for a Simulated Methane Fire, *Fire Safety Journal*, 1990, pp. 443–458, vol. 16.

M.A. Delichatsios, Air Entrainment into Buoyant Jet Flames and Pool Fires, *Combustion and Flame*, 1987, pp. 33–46, vol. 70.

M.R. Dongworth and A. Melvin, Diffusive Catalytic Combustion, Proceedings, 16th Symposium (International) on Combustion, The Combustion Institute, Pittsburgh, P.A., 1976, pp. 255–264.

T. Griffin and L.D. Pfefferle, Gas Phase and Catalytic Ignition of Methane and Ethane in Air over Platinum, *Aiche Journal*, 1990, p. 861, vol. 36 No. 6.

T. Log and G. Heskestad, Temperatures of Restricted Turbulent Fire Plumes, *Fire Safety Journal*, 1998, pp. 101–115, vol. 31.

R.K. Lyon and J.A. Cole, Unmixed Combustion: An Alternative to Fire, *Combustion & Flame*, 2000, pp. 249–261, vol. 121.

* cited by examiner

*Primary Examiner*—Steven J. Ganey
(74) *Attorney, Agent, or Firm*—Brian D. Bellamy

(57) ABSTRACT

The present invention contributes a novel device and method of controlling fire growth by diverting the heat release site from the flame zone to an easily extinguishable catalytic surface. The invention introduces a screen or mesh having a catalytic coating into a flame and causes severe flame instability. The catalytic surface of the screen has a significantly lower activation energy than the flame zone. Therefore, upon insertion of the catalytic screen into the flame plume, the heat release site transitions from the flame zone to the catalytic screen, and the glowing surface of the screen replaces the violent fire plume above a burning object. Because the glowing surface is less violent and combustion occurs at a much lower temperature, the fire is prevented from propagating to nearby structures. Further, without the strong buoyancy forces of hot gases rising upward and flame being augmented by crosswinds, the glowing surface of the catalytic screen is readily extinguished.

29 Claims, 6 Drawing Sheets

DEVICE AND METHOD FOR CONTROLLING FIRE

BACKGROUND OF THE INVENTION

This invention relates to a device and method of suppressing fire plumes above combustible structures. More particularly, the present invention relates to controlling and suppressing fires by inserting a catalytic screen into the fire and diverting the reactions from the violent flame zone to a silent catalytic solid surface.

When a flaming combustion starts, the hot flame above the burning object acts as an aerodynamically strong diffusion pump powered by natural buoyancy forces. Ambient air is entrained along the boundary of the flame because of the upward movement of hot combustion gases caused by the large buoyancy forces. The violence of the fire thus depends on the buoyancy force generated by hot gases rising above the fire and the ambient air rushing into the fire. More often than not, crosswinds augment the fire violence. In time, the flame turns into a propagating large-scale fire with ever increasing strength and ability to destroy nearby combustible objects. Out of control fires cause severe threats to both life and property at an ever increasing rate. Thus, a critical need exists for newer and more efficient fire control methods.

Current methods used to suppress fires of various magnitudes include cooling the fire by water mist, blanketing oxygen influx by using heavy gases such as carbon dioxide and foam, and inhibiting chain-branching chemical reactions in the flame by using chemical additives. Chemical additives include, but are not restricted to, the halons CF2Br2 and CF2BrCl, and certain dry powders. Additionally, some explosive reactions are used to aerodynamically blow off the flame and assist in suppressing the fire.

The degree of success achieved in these methods depends on the specific fire scenario at hand. The prior art methods are known to present serious limitations under various fire scenarios. For instance, the water spray methodology of controlling fires is the most widely used, but the water mist is often incapable of penetrating against the upward fire flow into the surface to cool the fire. In addition, chemical additives are not always effective, and they pose pollution problems that may be caused by their use in controlling fires. Therefore, suppression of wild fires and uncontrolled fires generally continues to be difficult, especially for very violent fires of great strength having strong upward flow of hot combustion gases.

Some attempts have been at using some type of screen or mesh covering inside fire plumes to assist in controlling fire. However, previous studies reporting the effect of including non-catalytic screens inside fire plumes indicate that screens provide little assistance in suppressing a flame. In a journal article, T. Log and G. Heskestad, Fire Safety Journal, volume 31, 1998, describe variations of flame properties upon introducing a non-catalytic metal screen into the flame. The authors report a net increase in time-averaged flame temperatures. The placement of an inert surface inside a flame did not change the overall chemistry and dynamics of the flame.

U.S. Pat. No. 5,158,144 issued to Mark D. Shaw and Laurence M. Bierce on Oct. 27, 1992 teaches a method of creating a non-burning zone at the flame base by introducing a non-catalytic metal mesh or screen. By constantly raising the screen, a distance of free flowing fuel without fire can be created below the flame. The screen thus prevents the fire from burning below it mainly due to the aerodynamic effect. However the screen does not modify the properties of the flame burning above the screen.

Accordingly, it would be highly desirably to provide a method for using a screen or mesh for suppressing fire that would modify the flame properties such that the flame would be easily extinguished.

Certain combustion catalysts are known to create reactive surface sites by significantly reducing the activation energy of combustion reactions. Several theories have been proposed for the combustion and ignition of hydrocarbon fuels in the presence of noble metal catalysts as early as the 1970s and 1980s. The catalytic ignition behavior of a fuel- air system depends on the nature of catalysts, their effective surface area, and fuel-air equivalence ratios.

Applications for catalytic combustion technology exists in several camping accessories, household appliances and industrial combustion systems. In these existing applications, catalytic combustion technology is used to replacing flaming combustion with catalytic radiant glow to create flameless combustion applications for cooking, heating, and improving efficiency. However, prior art does not exist with respect to the application of catalytic combustion technology for suppressing and controlling violent fires.

SUMMARY OF THE INVENTION

The inventor has found that flaming gas phase combustion will transition to glowing surface combustion in the presence of a significantly lower activation energy catalytic surface. In the present invention, a fire is controlled by transforming the gas phase combustion of a violent flame into a surface catalytic combustion process, thus weakening or eliminating the violent fire plume above the burning structures.

The gas phase ignition temperature of a combustible mixture containing a gaseous fuel and air is generally above 1000° C. However, in the presence of a suitable catalytic surface, the fuel-air mixture can ignite at a much lower temperature because of lower activation energy of combustion. The ignition temperature can be as low as 400–500° C. depending on the nature of the catalyst. When the catalyst is heated to above its activation temperature, combustion reactions occur on the surface, resulting in a glowing surface. As the surface combustion becomes more efficient, the flame above the burning surface becomes weaker and unstable. At high enough catalytic combustion rates, the flame will disappear and leave behind a glowing surface, thus preventing the fire from propagating to nearby structures. Because of the near absence of a strong fire plume above the burning objects, a conventional sprinkler system can be easily used to cool the surface.

DETAILED DESCRIPTION OF THE INVENTION

Figure 1:
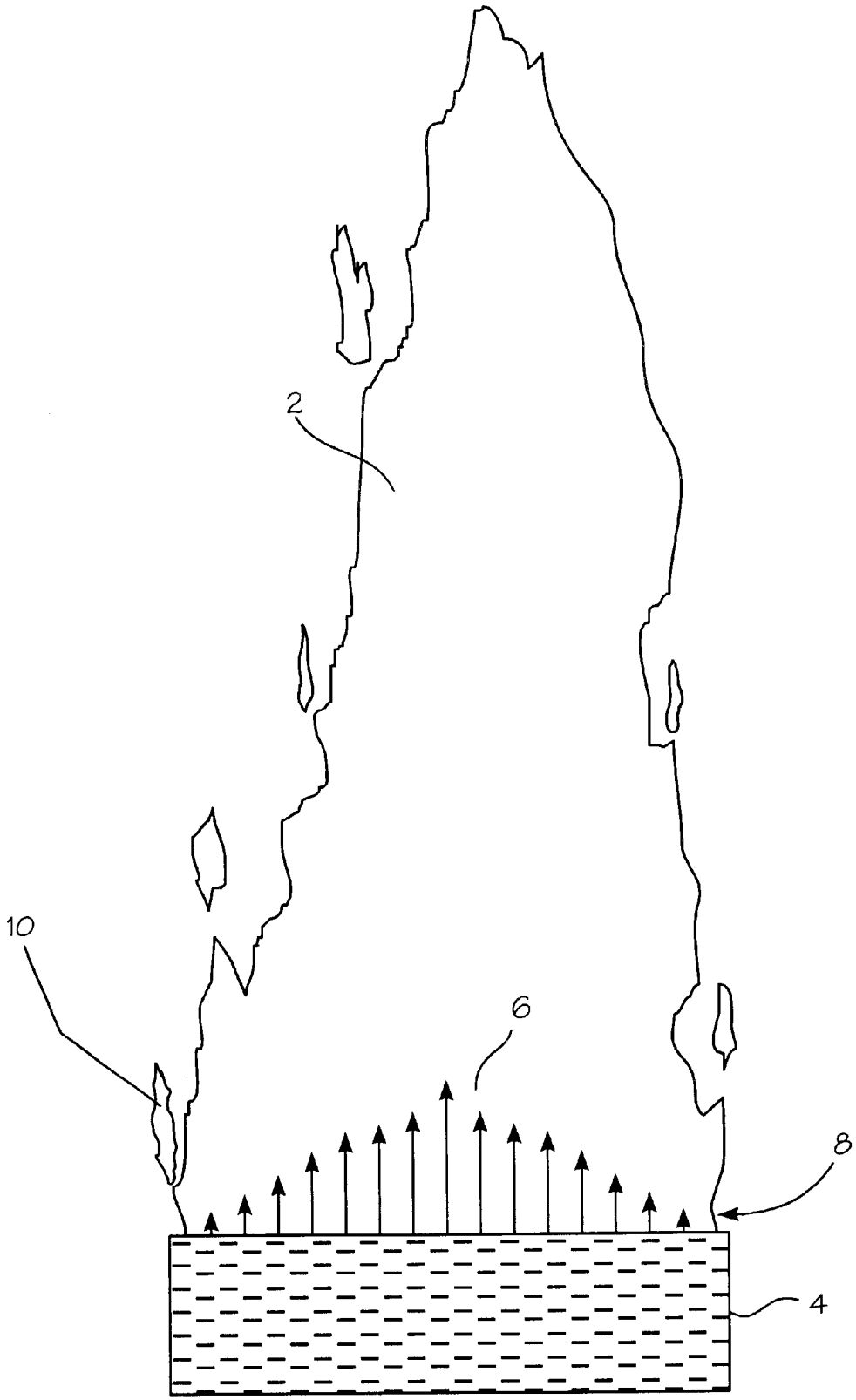
FIG. 1 depicts a typical fire plume above a burning object.

FIG. 1 shows a fire plume 2 established above a burning object 4. The burning object 4 is also considered a source 4 of fuel gas flow 6. The source 4 can be either gas or gaseous products produced from a condensed phase. The condensed phase includes solids, liquids, or a combination thereof. The fuel vapors from the burning object 4 rise into the upward flowing fire region as shown by fuel flow 6 and keep the fire 2 burning.

The air entrainment process 8 in a typical fire plume 2 is indicated in FIG. 1 by a downward arrow 8. The flow inside a moderate and large-scale fire 2 is highly turbulent. Air and fuel vapors meet and burn instantaneously at locations 10 at the fire's boundaries as a diffusion flame. The combustion process in fires is usually diffusion-controlled. Chemical reaction rates are generally high. The hot gas phase above the fuel source 4, referred to as fire 2, is generally about 1600–2000° C. Depending on the fire size and crosswind conditions, the fire 2 moves violently at all sides and attempts to bounce onto nearby combustible objects.

Figure 2A:
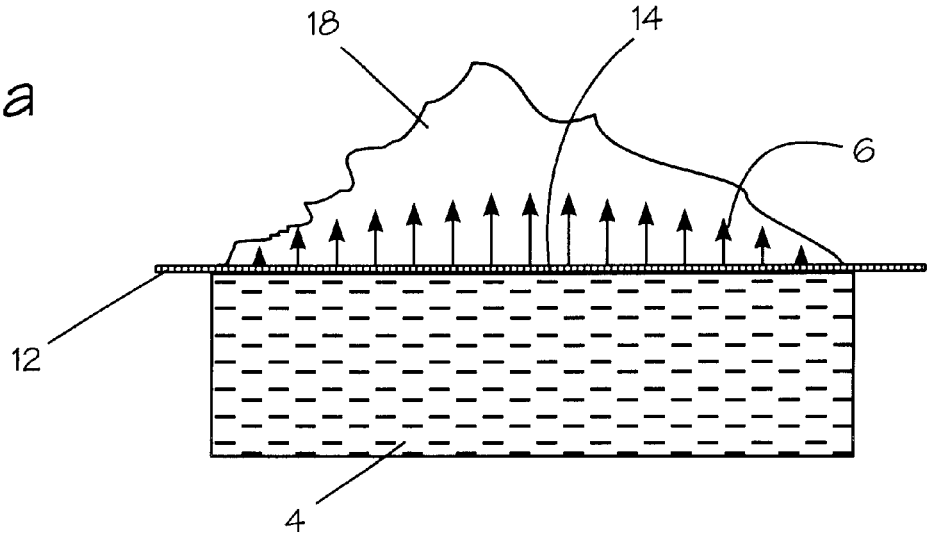
FIG. 2*a* illustrates a catalyst coated mesh screen of the present invention inserted at the flame base and having a reduced flame and a glowing surface.
Figure 2B:
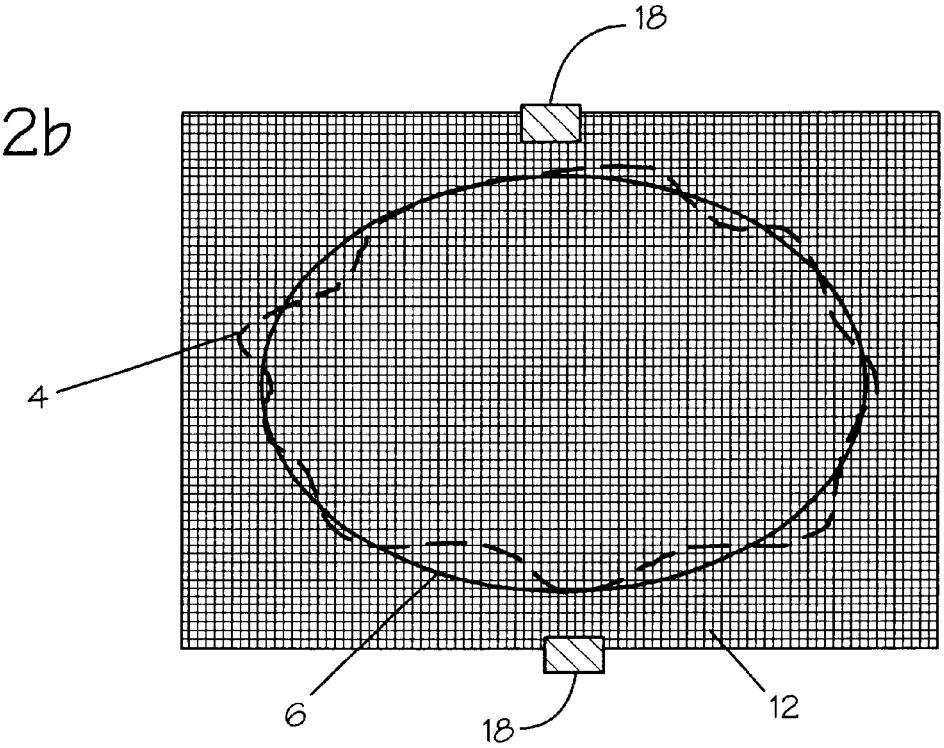
FIG. 2*b* illustrates a cut-away top view of a catalyst coated mesh screen as shown in FIG. 2*a* inserted at the flame base and having a reduced flame and a glowing surface.

In the present invention, a mesh material or a screen 12 is placed across the base 14 of the fire as shown in FIG. 2*a* and FIG. 2*b*. The screen 12 is coated with a catalytic material and is also referred to as a catalytic screen, catalytic screening member, or a fire-suppression screen 12. The catalyzing process begins, and the screen 12 quickly heats up to its activation temperature, which is lower because of the catalytic coating. The fuel-air mixture ignites at a temperature as low as 400–500° C. because of lower activation energy caused by the combustion catalyst. When the catalyst is heated to above its activation temperature, combustion reactions occur on the surface of the screen 12.

The catalytic screen member 12 is heated to its activation temperature during its descent to the fire's base 14. Thus, the catalytic screen 12 is immediately hot enough to cause surface combustion reactions and begin the transition to surface glow. When the flame boundary meets the screen 12 at reaction point 16, the oxygen of the air entrainment process 8 and fuel vapor of the fire 2 react and release heat producing a glow as shown at the reaction point 16. Both the reduced flame 18 and initial glow reaction 16 are seen immediately after inserting the screen 12. Initially, the glowing region follows the shape of the fuel as shown by reaction point 16 in FIG. 2*b*. This is because the oxygen and fuel meet the screen 12 at the locations where the temperature of the screen 12 is above the catalyst activation temperature. At the center of the screen 12, a weak flame 18 may persist. If the screen 12 is fine enough, the fuel flow 6 will be partially blocked from rising above, and the flow will go sideways and meet the oxygen at the edge of the screen 12.

Figure 3A:
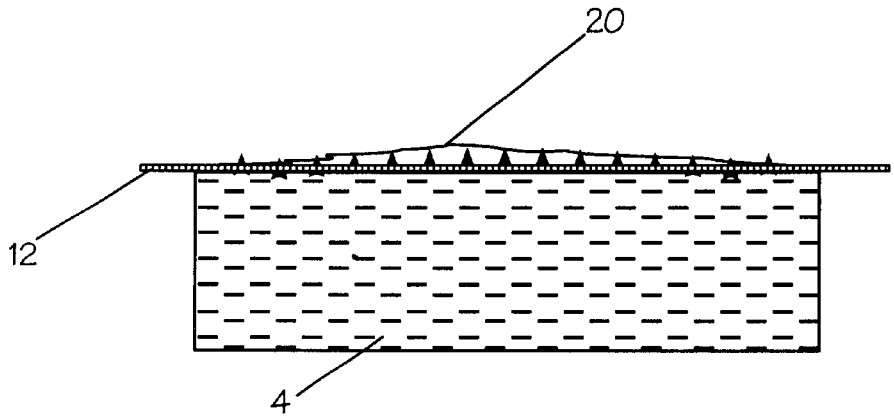
FIG. 3*a* and FIG. 3*b* illustrate a catalyst coated mesh screen of the present invention inserted at the flame base and having a glowing surface.
Figure 3B:
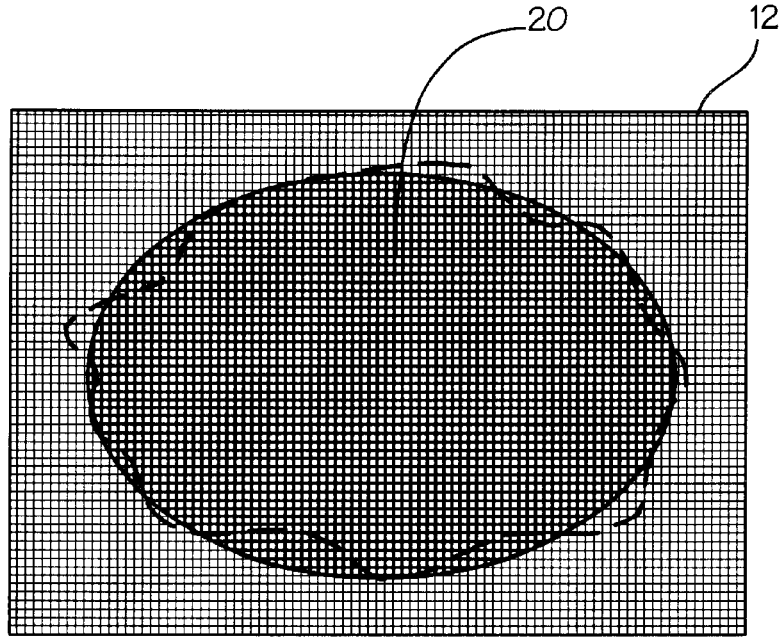

FIG. 3*a* and FIG. 3*b* show the transition from the residual fire 18 in FIG. 2*a* to a glowing surface 20 with a temperature about 1000° C. The placement of the catalyst coated screen 12 into the base 14 of the fire plume 2 causes the fire 2 to transition into a glow 20 that replaces the fluid dynamically strong, and violent fire plume 2 depicted FIG. 1. Because the glow is less violent, the reaction event is much safer and manageable. Primarily, the glow will not ignite nearby objects as a violent flame 2 will. Further, the glow 20 is easily extinguished by cooling the glowing surface with a standard system of dispensing water onto the surface. Alternatively, other fire extinguishing chemicals, fluids, solids, or methods may be applied to the glow 20 and will generally be highly successful in extinguishing the non-violent glowing surface.

Figure 4:
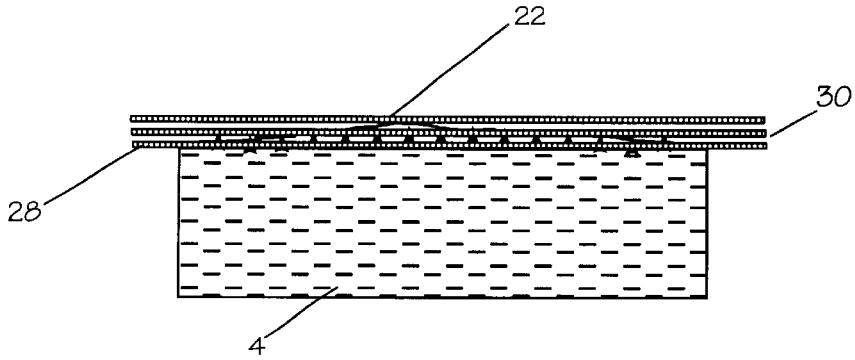
FIG. 4 illustrates multiple screens stacked onto a flame base.

In order to divert the upward bulk flow 6 through the center of the screen 12 as shown in FIG. 2*b*, multiple screens may be necessary. FIG. 4 describes a typical multiple mesh system 22 to obtain an effective transition from fire 2 to surface glows 20. The physical size of the screen 12 and its orientation depends on the fire scale and intensity. In FIG. 4 several screens including a catalytic screen 28 and non-catalytic screen 30 are shown stacked vertically. The vertically stacked arrangement of multiple screens may be useful in cases of fires 2 having very strong upward flow 6. The vertically stacked screens will provide several reactive surfaces such as the reactive surfaces 16 in FIG. 2*b*. Multiple reactive surfaces may assist in controlling the fire 2 and causing the fire 2 to transition into catalytic surface glow 20 on the screens.

Figure 6:
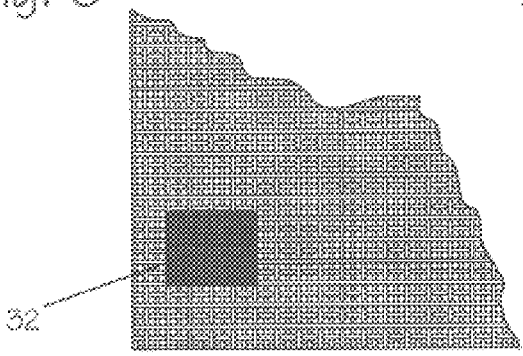
FIG. 6 illustrates a catalyst coated screen of the present invention having a mesh structure with impermeable regions.

In addition to the catalyst coated mesh 28 in the multiple mesh system 22, the alternate mesh 30 may be a simple mesh without a catalytic coating. In addition, random patches of impermeable regions 32 may be used on a mesh as shown in FIG. 6 to block the upward flow 6 and accelerate the transition to surface glow.

Figure 7:
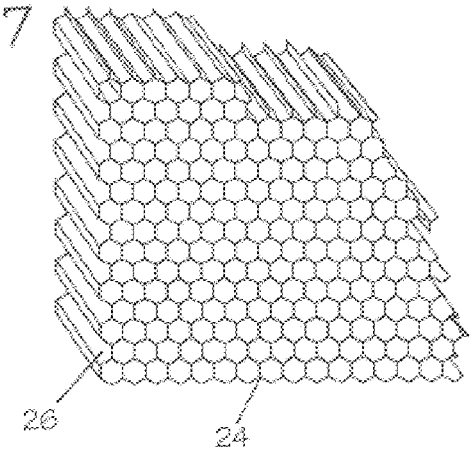
FIG. 7 illustrates a honeycomb substrate structure coated with catalysts as an alternative embodiment of the present invention.
Figure 8:
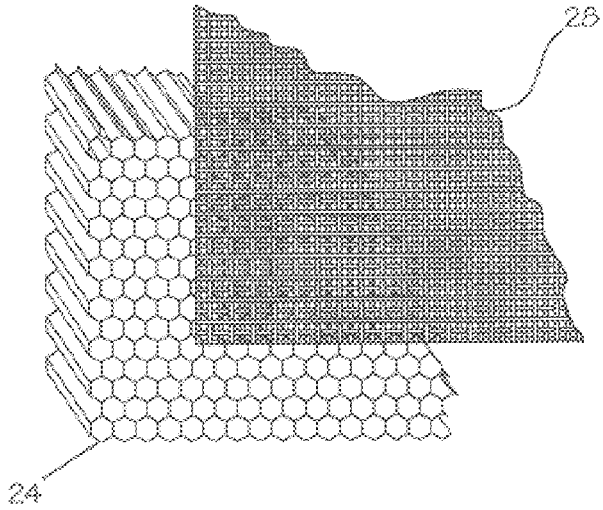
FIG. 8 illustrates as an alternative embodiment of the present invention a combination of a mesh catalyst screen structure and a honeycomb substrate structure coated with catalysts.

Alternatively, a honeycomb structure 24 may be used as shown in FIG. 7. The depth of the honeycomb channel 26 in FIG. 7 may be suitably dimensioned to get an optimum fire transition result. It is also possible to use a combination of a screen 28 and a honeycomb structure 24 as shown in FIG. 8.

Figure 5:
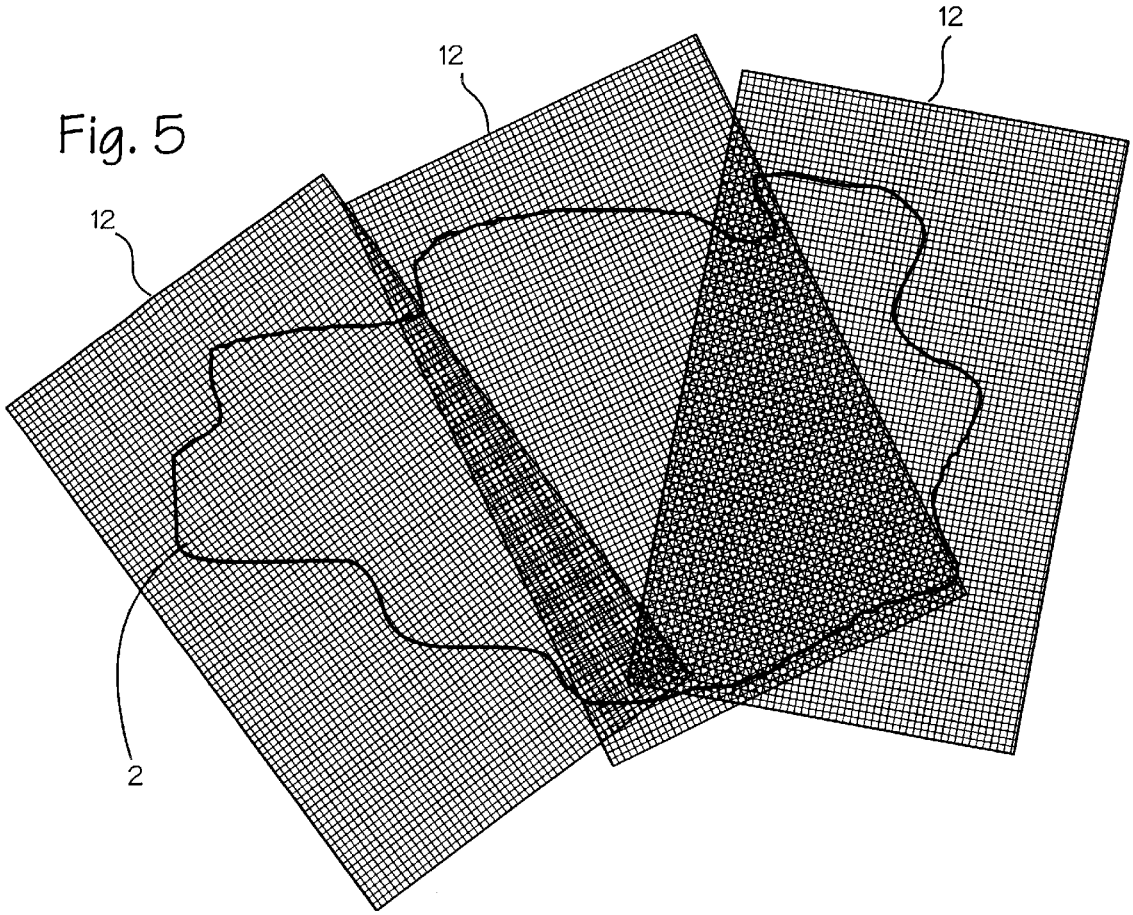
FIG. 5 shows a plurality of screens spread over a flame base to cover a wider area of fire.
Figure 9:
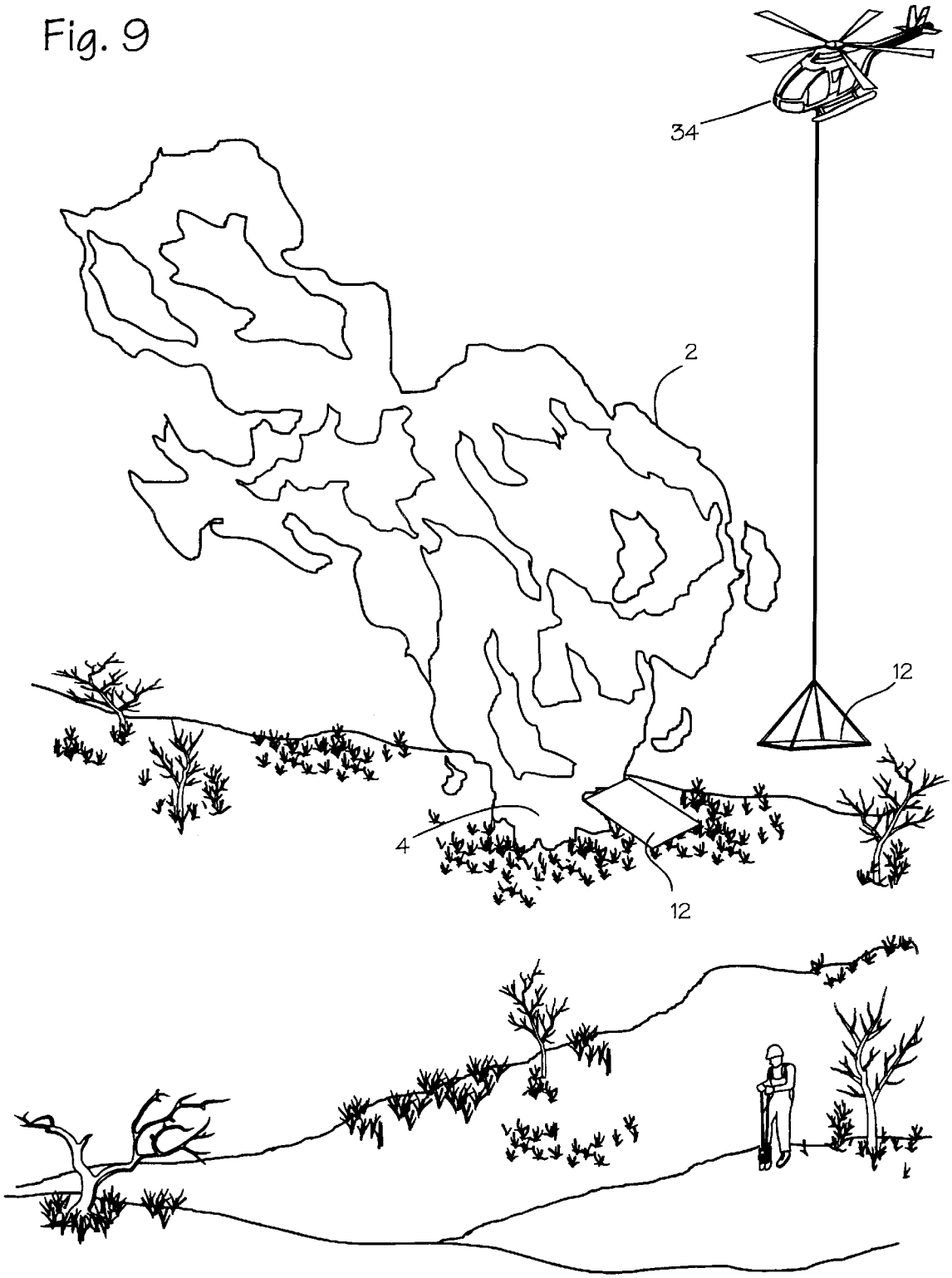
FIG. 9 illustrates a means of inserting the catalyst coated screen into a flame base.

The position and dimensions of the screen 12 are optimized for each fire scenario based on the magnitude of the area and flow 6 of the fire 2. Depending on the area of the fire source 4, several units of individual screens 12 may be combined and linked together as illustrated by FIG. 5. The screens 12 may be retained against the fire base 14 by their own weight, or further support may be added depending on the specific fire scenario. In suitable cases, weights 18 may be added to hold the screen 12 in place against the upward fire flow 6. Various wheels and pulleys and equipment such as cranes, lifts, or aircraft may be used to position screens in certain fire scenarios. A possible scenario using an aircraft 34 to place multiple catalytic screening members 12 at the source 4 of a wildfire 2 is illustrated in FIG. 9.

The catalyst and substrate combined form a fire screening member 12 for insertion into a fire plume 2. Catalytic materials for coating the screen 12 may include platinum, palladium and their alloys, transition metal oxides, and other low temperature oxidation catalysts. The alloys of the these metals may be used for more effective catalyst performance. A catalyst having a composition with an extremely low activation or light off temperature is desirable to cause a quicker transition from fire to glow. The surface reactions caused by the combustion catalyst may be further accelerated by supplying additional air or oxidizing chemicals to the surface of the catalytic screen 12.

These catalysts are coated on a substrate material or screen 12 of sufficient mechanical strength. The substrates may also be called catalyst support materials. Preferably, the catalyst will very thinly coated on the substrate. A thin coating of the catalyst is still be effective and cost efficient. The known process of modem chemical vapor deposition (CVD) or any other thin-coating method may be utilized to formulate an efficient catalytic screen. After a reasonable number of fire control applications, the catalytic surface of the screening member is regenerated. Similarly, after the catalytic surface become ineffective, it may be re-coated with the catalyst.

Typical substrates may include metal screens or meshes, honeycomb structures, or a foam-like network. Other non-combustible materials and fibers that may be used as substrates include ceramic foam, a non-oven carbon mat, graphitic felt, carbon fiber yarn, carbon felt, woven ceramic fibers, fiberglass mats, and monoliths, also referred to as honeycombs. Various substrates may be used and the list provided is not intended to be all inclusive. In some cases, the substrate and catalyst of the screening member may be combined or the same material rather than having a substrate that is coated by a separate catalytic material. Obvious variations and combinations of both catalytic coatings and substrates will become apparent to those skilled in the art. Typically, preferred embodiments of the invention will consist of very fine stainless steel screens of grid size 0.1 mm and wire diameter 0.2 mm. The preferred grid size and wire diameter will vary with fire size and flow behavior. The screen's grid size may vary from about 0.1 mm to about 30 mm and wire diameters may vary from about 0.1 mm to about 0.8 mm.

The method and device described may be used to control and suppress many different types of fires. Typical fires that may be controlled using the invention include localized small fires, residential pool fires, residential and office building fires, aircraft and automobile fires, oil-well fires, fires on waters, fuel tank fires, oil spill fires, and wildfires including forests and grasslands. A further advantage of the present invention is that the catalytic combustion utilized by the methods and devices of the present invention produces relatively low pollutants as compared to sooty natural fires.

It will be obvious to those skilled in the arts that substitutions and equivalents will exist for the elements of the embodiment illustrated above. The true scope and definition of the invention, therefore, is to be as set forth in the following claims.

I claim:

1. A method of controlling fire comprising the steps of providing a catalytic screening member, providing a combustion catalyst on a surface of the catalytic screening member, and placing the catalytic screening member into a flame causing said flame to transition into a glowing surface.

2. A method of controlling a fire as claimed in claim 1, further including the step of extinguishing said glowing surface.

3. A method of controlling a fire as claimed in claim 2 in which said step of extinguishing said glowing surface includes applying water to said glowing surface.

4. A method of controlling a fire as claimed in claim 2 in which said step of extinguishing said glowing surface includes subjecting said glowing surface to crosswinds.

5. A method of controlling fire as claimed in claim 1 in which said catalytic screening member is comprised of stainless steel and the step of providing a combustion catalyst on the surface of the catalytic screening member includes coating the surface of the catalytic screening member with the combustion catalyst.

6. A method of controlling a fire as claimed in claim 5 in which said stainless steel screen has a grid size of 0.1 mm and a wire diameter of 0.2 mm.

7. A method of controlling fire as claimed in claim 1, further including the step of supplying a supplemental flow of oxygen to said catalytic screening member to facilitate the transition into said glowing surface.

8. A method of controlling fire as claimed in claim 1, further including the step of supplying an oxidizing chemical to said catalytic screening member to facilitate the transition into said glowing surface.

9. A method of controlling fire as claimed in claim 1, further including the step of providing a non-catalytic screening member and in which said catalytic screening member and the non-catalytic screening member are placed into said flame by stacking the catalytic screening member and the non-catalytic screening member vertically.

10. A method of controlling a fire as claimed in claim 1 in which the step of supporting the combustion catalyst on the catalytic screening member includes coating the catalytic screening member with the combustion catalyst.

11. A method of controlling a fire as claimed in claim 1 in which the combustion catalyst is either platinum or palladium and their alloys.

12. A method of controlling fire comprising the steps of providing a catalytic screening member, providing a substrate supporting a catalyst on the catalytic screening member and placing the catalytic screening member into a flame causing said flame to transition into a glowing surface.

13. A method of controlling a fire as claimed in claim 12 in which said catalyst is either platinum or palladium and their alloys.

14. A method of controlling a fire as claimed in claim 12 in which said catalyst is a transition metal oxide.

15. A method of controlling fire as claimed in claim 12 in which said catalyst is coated onto said substrate using modem chemical vapor deposition.

16. A device for controlling a fire having a flame plume and a base, comprising a catalytic screen member formed of a substrate having at least one surface thereof coated by a catalyst.

17. A device for controlling a fire as claimed in claim 16 in which said substrate is a mesh screen.

18. A device for controlling a fire as claimed in claim 16 in which said substrate is a foam sheet.

19. A device for controlling a fire as claimed in claim 16 in which said substrate is a screen made of stainless steel.

20. A device for controlling a fire as claimed in claim 16 in which said substrate is a honeycomb sheet.

21. A device for controlling a fire as claimed in claim 16 which said substrate consists of non-combustible fibers.

22. A device for controlling a fire as claimed in claim 16 in which said catalyst is a transition metal oxide.

23. A device for controlling a fire as claimed in claim 16 in which said substrate includes impermeable areas to achieve a desired flow resistance.

24. A device for controlling a fire having a flame plume and a base, comprising a catalytic screen member formed of a substrate having at least one surface thereof coated by a catalyst in which the catalyst is either platinum or palladium and their alloys.

25. A device for controlling a fire having a flame plume and a base, comprising multiple screen members with at least one screen member having a catalytic surface supporting a combustion catalyst.

26. A device as claimed in claim 25 including a means for linking said screen members together to cover a larger area of said fire.

27. A device as claimed in claim 25 in which said screen members are stacked vertically for controlling said fire.

28. A device as claimed in claim 25 including at least one screen member having a non-catalytic surface.

29. A device for controlling a fire having a flame plume and a base, comprising a catalytic screen member having a surface thereof coated by a combustion catalyst in which the combustion catalyst is coated onto the surface using chemical vapor deposition.

* * * * *